US010947751B2

(12) United States Patent
Lockwood et al.

(10) Patent No.: US 10,947,751 B2
(45) Date of Patent: Mar. 16, 2021

(54) UTILITY POLE WITH TRANSPARENT PORTION

(71) Applicant: COMPTEK TECHNOLOGIES, LLC, Boulder, CO (US)

(72) Inventors: James D. Lockwood, Boulder, CO (US); Kenneth Michael Hoganson, Aurora, CO (US)

(73) Assignee: Comptek Technologies, LLC, Boulder, CO (US)

( * ) Notice: Subject to any disclaimer, the term of this patent is extended or adjusted under 35 U.S.C. 154(b) by 0 days.

(21) Appl. No.: 16/295,952

(22) Filed: Mar. 7, 2019

(65) Prior Publication Data

US 2019/0277050 A1 Sep. 12, 2019

Related U.S. Application Data

(60) Provisional application No. 62/639,723, filed on Mar. 7, 2018.

(51) Int. Cl.

| | |
|---|---|
| ***E04H 12/02*** | (2006.01) |
| ***H01Q 1/12*** | (2006.01) |
| ***F21V 15/01*** | (2006.01) |
| ***E04H 12/00*** | (2006.01) |
| ***F21S 8/08*** | (2006.01) |
| ***F21V 33/00*** | (2006.01) |
| *F21V 21/10* | (2006.01) |

(52) U.S. Cl.

CPC ..... *E04H 12/02* (2013.01); *E04H 12/003* (2013.01); *F21S 8/086* (2013.01); *F21V 15/01* (2013.01); *F21V 33/00* (2013.01); *H01Q 1/1242* (2013.01); *F21V 21/10* (2013.01); *F21V 33/0052* (2013.01)

(58) Field of Classification Search

CPC .... E04H 12/02; E04H 12/003; H01Q 1/1242; F21V 15/01; F21V 21/10; F21V 33/00; F21V 33/0052; F21S 8/086; F21W 2131/103

USPC ..... 52/831, 834, 835, 843, 844, 845, 848

See application file for complete search history.

(56) References Cited

U.S. PATENT DOCUMENTS

| | | | | |
|---|---|---|---|---|
| 3,633,984 | A * | 1/1972 | Smollen | G02B 5/226 359/359 |
| 4,224,082 | A * | 9/1980 | Jacobson | H02S 40/44 136/248 |
| 6,167,673 | B1 * | 1/2001 | Fournier | E04H 12/02 52/834 |
| 7,731,383 | B2 * | 6/2010 | Myer | F21V 29/83 362/145 |
| 8,029,154 | B2 * | 10/2011 | Myer | F21V 29/004 362/145 |
| 9,698,477 | B1 * | 7/2017 | Jabara | E04H 12/003 |
| 9,837,698 | B2 * | 12/2017 | Lasier | H01Q 1/1207 |
| 10,247,406 | B2 * | 4/2019 | Abbott | H01Q 1/44 |

(Continued)

*Primary Examiner* — Brent W Herring

(74) *Attorney, Agent, or Firm* — Snell & Wilmer L.L.P.; Russell T. Manning

(57) ABSTRACT

A multiuse utility pole is presented that may house various public and quasi-public infrastructure. In one non-limiting embodiment, the multiuse pole houses cell control equipment and one or more cellular antennas. In any embodiment, the multiuse pole incorporates an optically transparent or translucent section (hereafter transparent section) in its pole structure that allows for enclosing a camera such that the camera has a substantially unobstructed 360-degree field-of-view.

8 Claims, 11 Drawing Sheets

(56) References Cited

U.S. PATENT DOCUMENTS

| | | | | |
|---|---|---|---|---|
| 10,505,271 | B2 * | 12/2019 | Constance | H01Q 1/44 |
| 10,663,128 | B2 * | 5/2020 | Abbott | F21S 9/02 |
| 2003/0233806 | A1 * | 12/2003 | Kuebler | E04H 12/003 52/838 |
| 2004/0070985 | A1 * | 4/2004 | Haddad | E04H 12/02 362/431 |
| 2009/0040750 | A1 * | 2/2009 | Myer | F21S 8/083 362/183 |
| 2010/0026604 | A1 * | 2/2010 | Caldwell | H01Q 1/1242 343/890 |
| 2010/0231469 | A1 * | 9/2010 | Kim | H01Q 1/246 343/721 |
| 2015/0349399 | A1 * | 12/2015 | Lasier | H01Q 1/06 343/721 |
| 2016/0146438 | A1 * | 5/2016 | LaFemina | F21V 21/10 362/368 |
| 2017/0030571 | A1 * | 2/2017 | Kawahara | F21V 21/10 |
| 2017/0122546 | A1 * | 5/2017 | Abbott | F21V 33/00 |
| 2017/0279187 | A1 * | 9/2017 | Lockwood | H01Q 1/246 |
| 2018/0077324 | A1 * | 3/2018 | Adrain | H04N 5/2256 |
| 2018/0172229 | A1 * | 6/2018 | Lockwood | H02S 30/20 |
| 2018/0219278 | A1 * | 8/2018 | Wigdahl | E04H 12/003 |
| 2018/0351245 | A1 * | 12/2018 | Constance | H01Q 1/44 |
| 2019/0137084 | A1 * | 5/2019 | Kim | F21V 21/22 |
| 2019/0226672 | A1 * | 7/2019 | Abbott | H01Q 21/205 |
| 2020/0118054 | A1 * | 4/2020 | Bayges | H04B 17/318 |
| 2020/0136236 | A1 * | 4/2020 | Colapietro | H01Q 1/243 |
| 2020/0185823 | A1 * | 6/2020 | Constance | H01Q 1/245 |
| 2020/0190842 | A1 * | 6/2020 | Ducros | H02G 3/083 |

* cited by examiner

UTILITY POLE WITH TRANSPARENT PORTION

CROSS REFERENCE

The present application claims the benefit of the filing date of U.S. Provisional Application No. 62/639,723 filed on Mar. 7, 2018, the entire contents of which is incorporated herein by reference.

FIELD

The present disclosure relates to multiuse utility poles used for supporting public and quasi-public infrastructure. More specifically, the present disclosure is directed to a multiuse utility pole that may unobtrusively support one or more surveillance cameras.

BACKGROUND

In many urban settings, public or quasi-public infrastructure is often located in the right-of-way of public roads. For instance, utility poles such as street lights and power poles are often located in the right-of-way of roads and/or highways. For example, such utility poles are often positioned on or at the edge of pedestrian sidewalks.

In addition to utility poles, small cell poles are increasingly being located at street level (e.g., in the public right-of-way). That is, with the increasing use of mobile data, a trend has been toward increasing the density of cell poles in urban environments. By way of example, proposed 5G wireless networks promise greatly improved network speeds and are currently being planned and implemented. However, such networks require shorter RF transmission distances compared to existing networks and require more dense networks of access points/small cell poles to handle data traffic. In various municipalities, small cell poles are being added to public rights-of-way to handle additional bandwidth requirements.

In addition to the above-mentioned utility poles and cell poles, many urban areas are seeing an increase of public safety equipment being positioned within the environment. Such equipment includes, without limitation, gun shot sensing equipment and surveillance cameras. In the latter regard, it is not uncommon for a single city block to include numerous cameras mounted on existing or dedicated structures to provide a full field-of-view for an area.

The increasing amount of public infrastructure is sometimes referred to as infrastructure densification. Residents of many communities have objected to such densification in their neighborhoods due to, among other things, the aesthetic concerns of such infrastructure.

SUMMARY

In one arrangement, a multiuse utility pole is presented that may house various public and quasi-public infrastructure. In one non-limiting arrangement, the multiuse pole houses cell control equipment and one or more cellular antennas. The multiuse pole may additionally support a streetlight. In any arrangement, the multiuse pole incorporates an optically transparent or translucent section (hereafter transparent section) in its pole structure that allows for enclosing a camera such that the camera has a substantially unobstructed 360-degree field-of-view. In most arrangement, the multiuse pole includes a lower equipment housing and a mono-pole structure that extends upward from the housing. The optically transparent section is typically disposed at an upper end of the mono-pole or between two mono-pole sections. In any arrangement, the optically transparent section forms a structural member that supports components located above the transparent section (e.g., cellular antennas, light masts etc.). The equipment housing and pole may be configured to mimic architecture of existing light poles.

In an arrangement, the equipment housing may include an inner cavity to allow for the installation and housing of, for example, cell control equipment. The pole portion of the multiuse utility pole may support various components such as, but not limited to, cellular antennas, street lights ext. Power and communications cables may extend to these components from the housing through a hollow interior of the monopole.

The multiuse pole includes an optically transparent or translucent portion that permits mounting of a camera in the pole (e.g., within a spatial envelope of the pole). The optically transparent portion may have a diameter that substantially matches the pole diameter such that this portion appears to be a portion of the pole. In such an arrangement, the optically transparent portion may attach to an upper end of a pole (e.g., supported by an equipment housing). The optically transparent portion may further support additional upper elements of the system. For instance, the transparent portion may support one or more antennas. In one arrangement, the transparent portion is a generally cylindrical and hollow element. Thick walled glasses, polymers and or composites may be used. In such an arrangement, the transparent portion may be a structural component having dimensions selected to withstand various loads applied by supported elements. For instance, wind loads, compressive loads etc. In an arrangement, the transparent portion may be prestressed (e.g., pre-compressed) to improve its structural qualities.

In one arrangement, the transparent portion is cylindrical. In such an embodiment, a camera may be mounted within the transparent portion. The camera may be mounted such that it may rotate within the transparent portion to provide, for example, 360-degree viewing. Alternatively, multiple cameras may be mounted within the optically transparent portion. In an arrangement, the transparent portion may include one-way optical properties allowing the camera to view outward while preventing inward viewing (e.g., visible light viewing) of the interior of the optically transparent portion. The camera may be optical, IR, UV etc. Further the camera may be a stereo camera with two or more lenses that permits the camera to see around obstructions within the transparent portion (e.g., prestressing rods/wires and/or cabling passing through the transparent portion).

In another arrangement, the pole portion of the system may include an armature that extends away from the long (e.g., upright) axis of the pole. Such an armature may support, for example, street lights or traffic lights. In a further arrangement, the armature may include interior space that may support additional components. In such an arrangement, the armature may include one or more windows or ports that permit an antenna or sensor to emit and/or receive signals.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

The present disclosure is directed to small multiuse utility poles that are configured for use in urban environments. In various embodiments, the utility poles are configured to support various modes of public and quasi-public infrastructure in a manner that minimizes their aesthetic obtrusiveness. Various embodiments of the utility poles support cell equipment as well as street lights. The utility poles may incorporate configurations that are similar to, for example, light poles currently existing in an urban environment. That is, the presented multiuse utility pole(s) may replace an existing light pole as well as support additional infrastructure such as cell equipment, sensors, camera etc. Along these lines, the inventors have recognized that the space within the interior of a utility pole may, in some instances, be utilized to unobtrusively house additional infrastructure. More particularly, the inventors have recognized that cameras may be incorporated into the spatial envelope of a utility pole to reduce the visibility of the camera while providing an improved field-of-view for such a camera. In an embodiment, the multiuse utility pole includes an annular transparent section for housing a camera. The annular transparent section of the multiuse utility pole provides a substantially unobstructed 360° field-of view. Further, the annular transparent section is a structural section of the multiuse utility pole allowing additional components of the utility pole system to be mounted above the annular transparent section while permitting the camera to be supported at a desired elevation in the multiuse utility pole.

Figure 1:
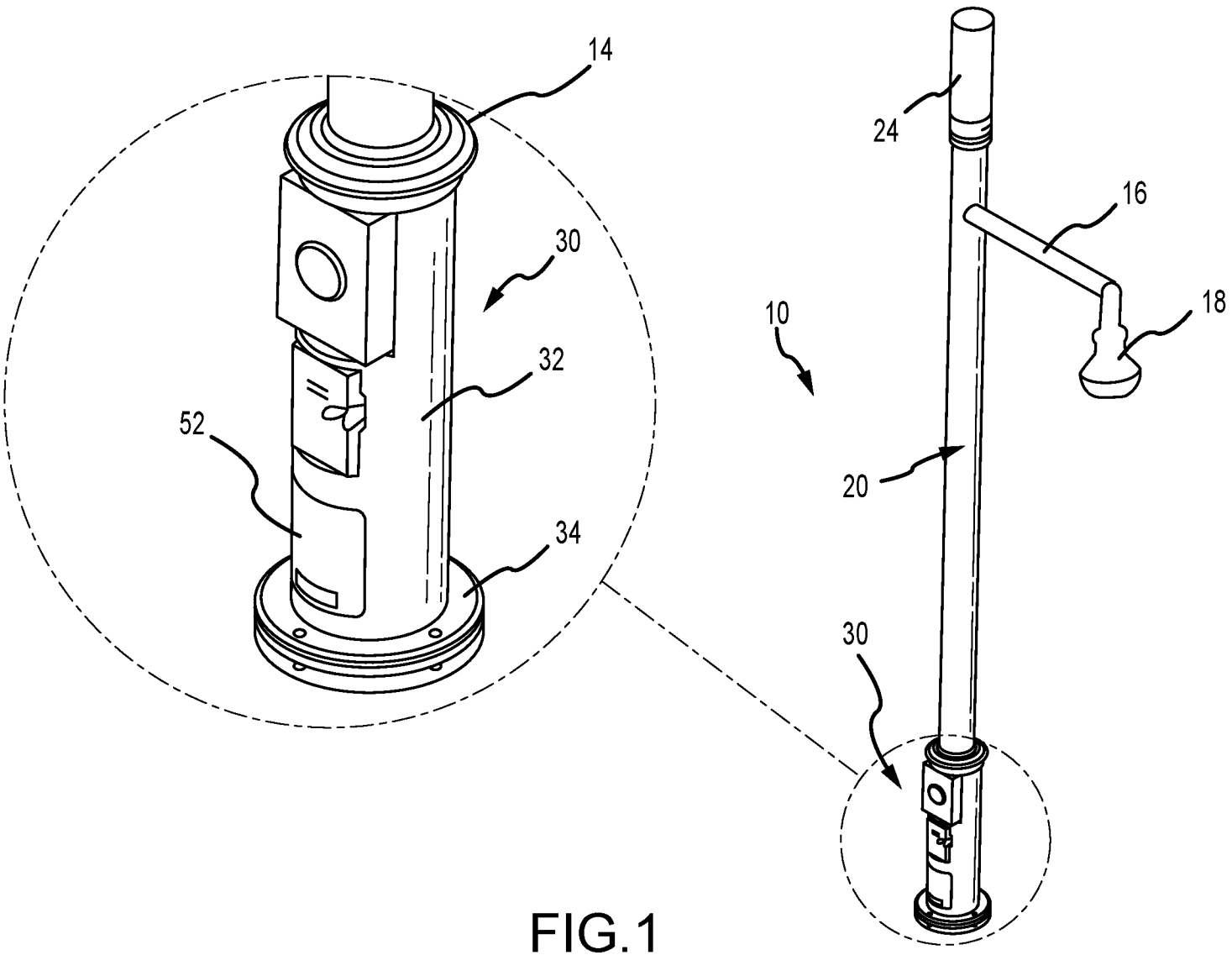
FIG. 1 depicts an example of a multiuse pole in accordance with the present disclosure.

FIG. 1 illustrates one embodiment of a multiuse utility pole configured to support cell equipment and street lights. Various features of such a pole are disclosed in co-owned U.S. Patent Publication No. 2017/0279187 and co-owned U.S. patent application Ser. No. 16/249,690, the entire contents of which are incorporated herein by reference. As shown, the multiuse pole 10 includes a lower equipment housing 30 (e.g., base housing) that includes an inner cavity (e.g., interior space) configured to house various equipment (e.g., cell control equipment). A mono pole 20 is attached to an upper surface of the equipment housing 30. An upper end of the mono pole 20 supports one or more antenna housings/structures 24. As shown, the multiuse pole 10 has a two-part design: the lower equipment housing 30 and the mono pole 20. The two-part construction allows for easier construction and implementation during set-up. That is, the equipment housing 30 can be installed separately from the mono pole 20 and/or antenna structure 24. Additionally, any equipment contained in the equipment housing may be installed at a later time. The present embodiment also illustrates a light mast or arm 16 attached to an upper portion of the mono pole 20. The illustrated light mast 16 supports a street light 18.

Figure 2:
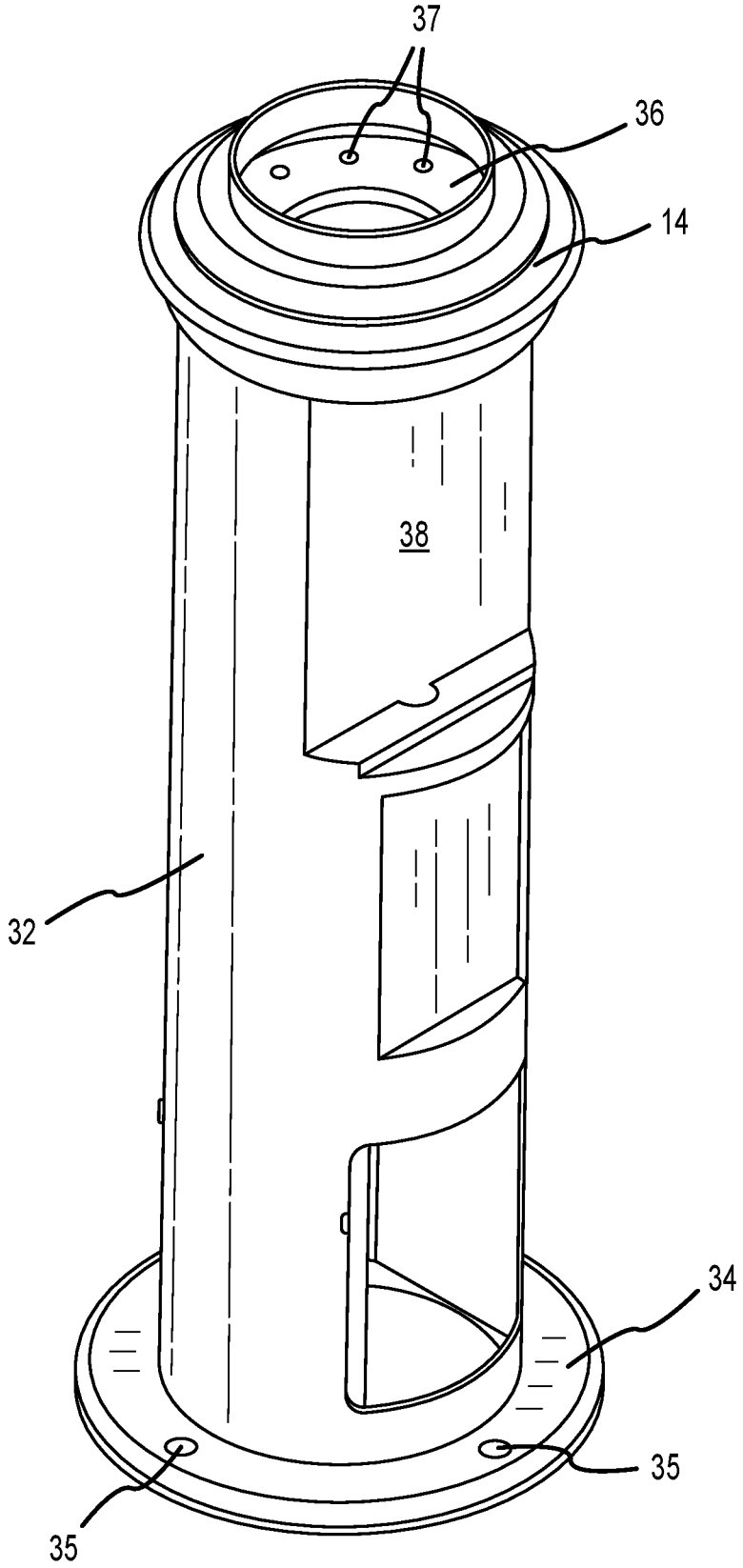
FIG. 2 depicts an example of a housing for use with the multiuse pole.

As shown in FIG. 2, the illustrated embodiment of equipment housing 30 has a generally cylindrical sidewall 32 that extends between a lower flange 34 and an upper flange 36. The generally cylindrical sidewall 32 defines an interior 38 (e.g., enclosed interior space) of the equipment housing 30. The lower flange 34 includes a plurality of apertures 35 (e.g., bolt holes) used to mount the housing 30 to a surface (e.g., ground, sidewalk, etc.). Other installation methods are possible. Typically, the lower flange 34 is an annular element with an open interior. The open interior of the lower flange allows routing various connections (e.g., electrical power, telecommunication lines, etc.) into the bottom of the housing 30. The upper flange 36 is likewise an annular element with an open interior. The upper flange 36 also includes a plurality of apertures 37 (e.g., bolt holes). Fasteners, such as bolts, may extend through the apertures 37 to attach the mono pole 20 to the top of the housing 30. The hollow interior of the equipment housing 30 may open into a generally hollow interior of the mono pole 20. This allows passage of cables from the equipment housing 30 through the open interior of the upper flange 36 into the interior of the mono pole 20 and to, for example, one or more antennas, lights or other devices (e.g., sensors) supported by the pole. Such an arrangement locates such connections internally making the multiuse pole less obtrusive to its environment.

As shown in FIGS. 1 and 2, a decorative shroud 14 is disposed on an upper end of the equipment housing 30. The shroud generally covers the interface between the housing 30 and the mono pole 20. The shroud 14 also directs water away from the interior of the housing. The configuration of the shroud may be varied to aid in assimilating the small cell pole with its urban surroundings. That is, the shroud provides for the ability to customize the structure to aesthetically fit in with the architectural theme of the location where the pole system is being installed. For instance, the multiuse pole may simulate the look and feel of a street light pole to better blend with its urban setting. Generally, the equipment housing 30 is utilized to house and enclose equipment for, for example, a cell access point while the mono pole 20 supports and/or houses one or more antennas. Utilization of the multiuse pole as a small cell pole is important for urban environments as right-of-way utilized for light poles is typically controlled by the municipalities. Along these lines, a cell provider may have access to locations for cell access points without having to engage multiple individual owners of different properties. That is, an existing light pole may be replaced with the small cell pole, which may incorporate a street light. However, in some instances, multiple cell providers may desire to utilize a common location.

Figure 3:
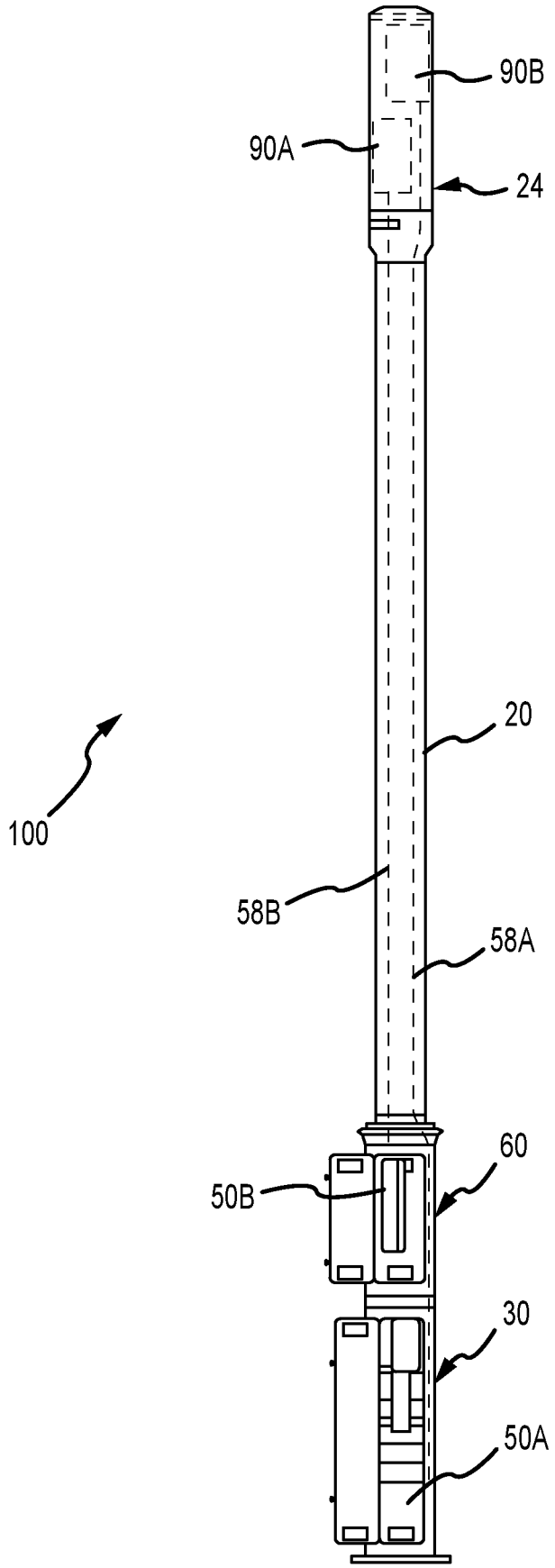
FIG. 3 depicts an example of modular multiuse pole.

To accommodate multiple providers at a single location, the multiuse pole may be a modular system where two or more equipment housings are stacked vertically to provide additional interior volume to house equipment for the pole system without increasing the footprint of the system. Such a modular multiuse utility pole system 100 is illustrated in FIG. 3. As shown, the modular system includes a lower equipment housing 30 (e.g., base housing), an upper equipment housing 60, which is disposed on top of the lower equipment housing 30, a monopole 20, and an antenna structure/housing 24. In the illustrated embodiment, cabling 58A (e.g., power and communications as illustrated by the dashed line) may pass from the cell control equipment 50A of the first wireless provider through the hollow interior of the lower housing 30, through the hollow interior of the upper housing 60, through the hollow interior of the mono pole 20 and connect to the first provider's antenna 90A in the antenna structure 24. Likewise, cabling 58B may pass from the cell control equipment 50B of the second wireless provider, through the hollow interiors of the upper housing 60 and mono pole to connect to the second provider's antenna 90A.

Aspects of the present disclosure are based on the recognition that the presented multiuse utility poles and similar poles could house additional components. More specifically, it has been recognized that a camera may be housed within the multiuse poles in an optically transparent or translucent section or portion of the pole that would provide a substantially unobstructed 360° field-of view. As utilized herein, optically transparent includes any material that a camera may see through. As will be appreciated, some material that are opaque to visible light camera may be transparent to UV and/or IR camera. Accordingly, the terms 'optically transparent' and 'transparent' should be broadly construed. Further, the transparent section allows for interior mounting of a camera protecting the camera from the weather and removing them from the surface of the pole reducing the aesthetic intrusion of such camera. Further, the inclusion of one-way materials permits removing the camera from the view of the public.

Figure 4:
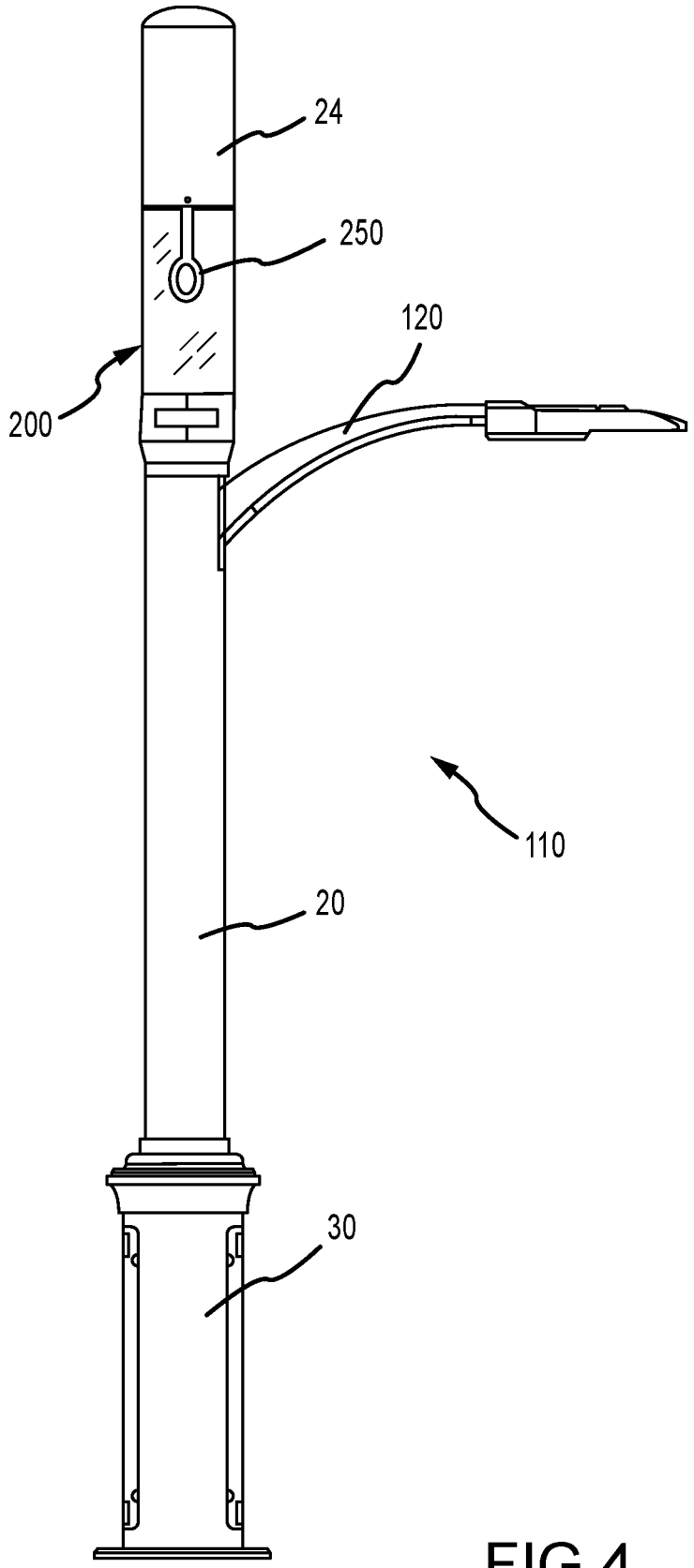
FIG. 4 depicts a first embodiment of a multiuse pole with a transparent section in accordance with the present disclosure.

FIG. 4 illustrates one embodiment of a multiuse pole 110 incorporating a transparent section 200 for use in mounting a camera within an interior of the pole. As shown, the multiuse pole 110 includes a lower equipment housing 30 which supports a monopole 20. In the present embodiment, the lower end of the monopole 20 is fixedly attached to the equipment housing 30. An upper end of the monopole 20 supports a lower end of a transparent or translucent portion or section 200. In the present embodiment the transparent section 200 houses a camera 250 (e.g., optical, infra-red, ultraviolet etc.) within its hollow interior. In this embodiment, the transparent section 200 forms a structural member of the multiuse pole 110 such that the upper end of the transparent section may support additional components. In the illustrated embodiments, the upper end of the transparent section 200 supports an antenna housing 24, which may house one or more antennas. The present embodiment of the multiuse pole 110 also supports an armature 120, which is connected to an upper portion of the monopole 20.

Figure 5:
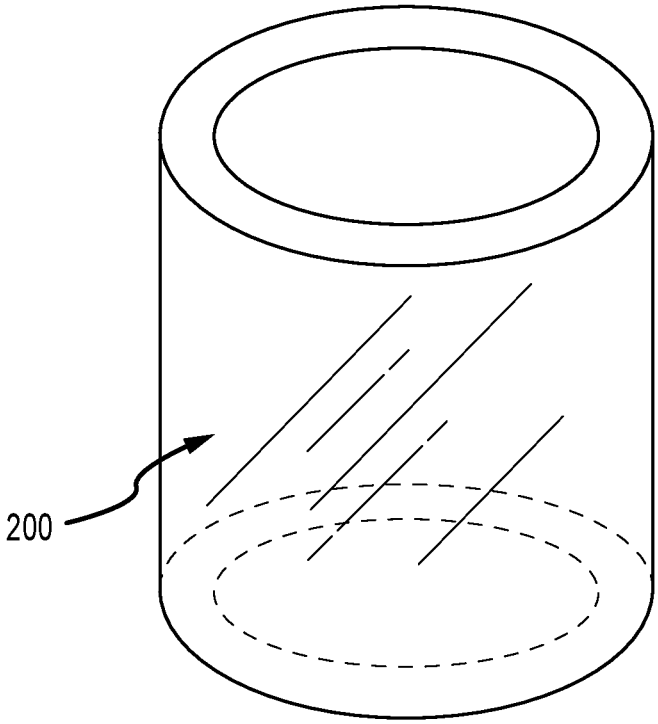
FIG. 5 depicts an annular transparent section.

As shown in FIG. 5, the transparent section 200 is a generally cylindrical element. The diameter and height of the transparent section 200 may be selected based on its intended use. Likewise, a wall thickness of the transparent section may be selected based on estimated loads that will be applied to the transparent section, for example, by components disposed above the transparent section. These loads include compressive loads, moment loads (e.g., from wind and or seismic forces). In application, the transparent section defines a load path through the pole form any upper components to the monopole. The transparent section may be made of any appropriate material including, without limitation, glass (tempered, structural, bulletproof) polymer (layered) etc.

Figure 6:
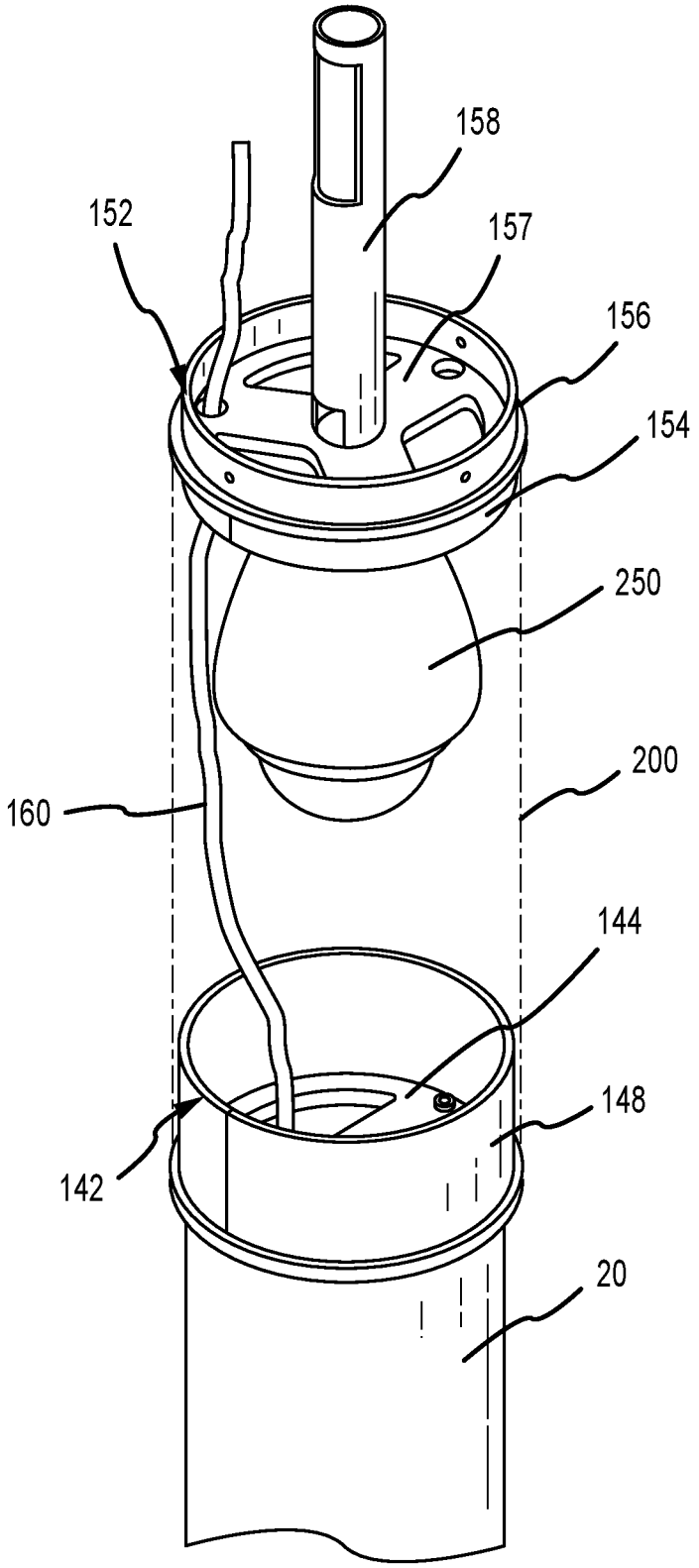
FIG. 6 depicts the annular transparent section disposed on the end of a pole.

As illustrated in FIG. 6, the transparent section 200 connects to the upper end of the monopole 60 *y* a lower bracket 142. As shown, the lower bracket 142 is a generally annular element having a vertical sidewall 448 configured to receive a lower portion of the lower end of the transparent member 440. That is, the sidewall 148 may be received within the interior of the transparent section 200 or vice versa. The sidewall 148 may attach to the transparent section 200 utilizing any appropriate means, including without limitation, mechanical fasteners and/or adhesives. The bracket 148 has a base plate 144 that is configured for attachment to a matching plate (not shown) connected to the upper end of the monopole 20. A decorative fairing or flange may cover the bracket to provide a more finished presentation for the system. In one embodiment, a coating may be applied to the outside surface of the transparent section to permit viewing from within the transparent portion while preventing viewing from the exterior.

An upper bracket 152 has a lower rim or sidewall 154 which may be received within or receive the upper end of the transparent section 200. The present embodiment of the bracket further includes an upper sidewall or rim 156 that is configured to be received within or receive the antenna housing 24 (see FIG. 4). The upper bracket includes a cross support 157 and post 158 on which an antenna element (not shown) may be mounted. Typically, the post 158 may be extend into an interior of the antenna housing for use in mounting, for example, an antenna element. Though illustrated as being axially aligned with a centerline axis of the transparent section, it will be appreciated that the post 158 may be offset from this axis.

In the present embodiment, the camera 250 is an omnidirectional camera that provides a 360° view through the transparent section 200. However, it will be appreciated that in other embodiments, the camera 450 may include multiple camera elements and or rotational elements to allow for controlled directional positioning of the camera. In any arrangement, it may be preferable, though not required, that a line of sight between the camera element and the sidewall of the transparent section 440 is disposed at or near 90°. That is, this line of sight may be normal to the interior surface of the transparent section to reduce distortion. However, this is not a strict requirement. In any embodiment, one or more power and or signal wires 160 may extend through the interior of the transparent portion 200 to provide power and/or communications with elements supported by the transparent housing and/or the camera 250.

Figure 7:
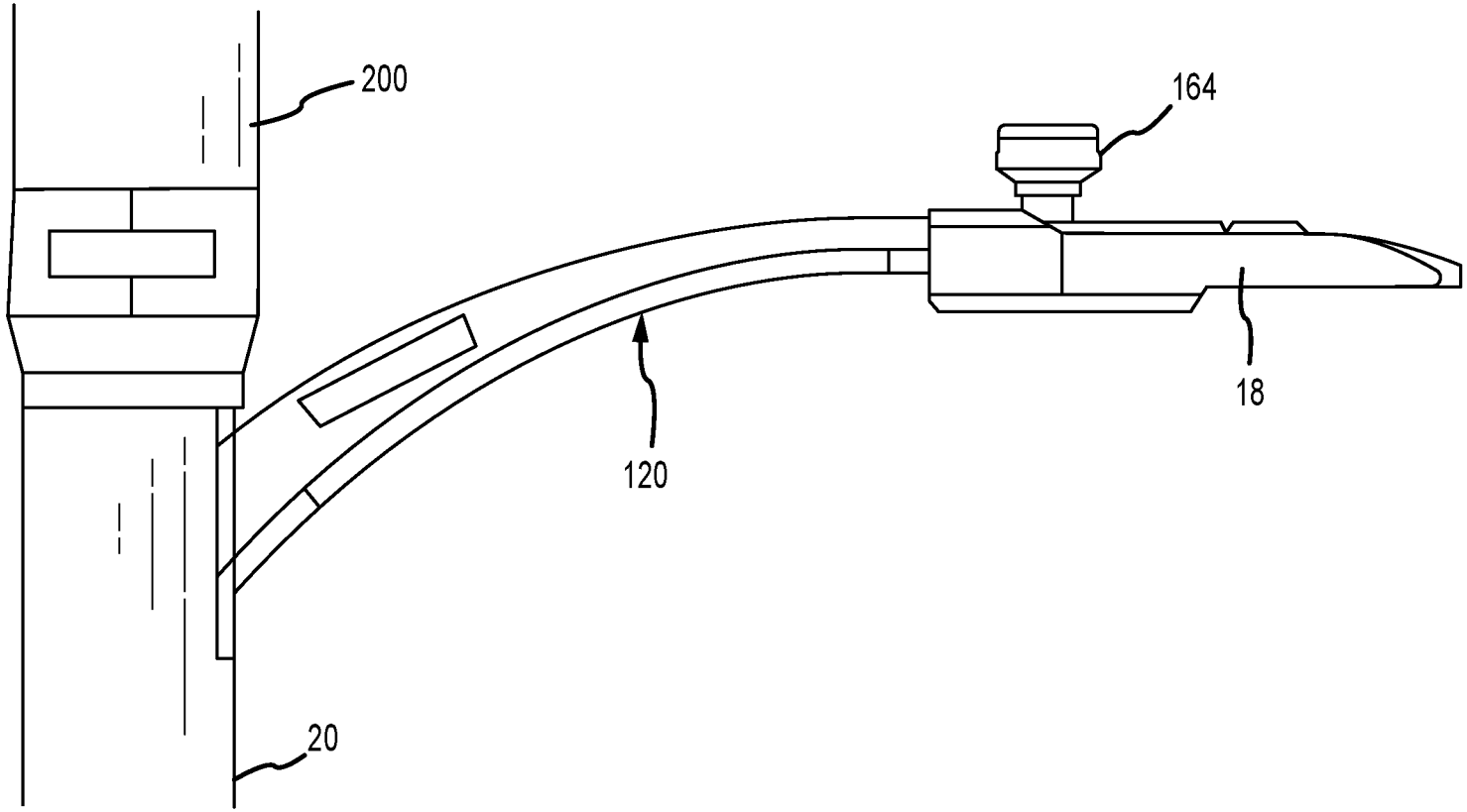
FIG. 7 depicts a light mast that may be incorporated with the multiuse pole.

FIG. 7 illustrates one embodiment of an armature 120 that may be attached to the monopole 20. As shown, this armature supports a street light 18. In the illustrated embodiment the streetlight further supports an antenna 164 such as a Bluetooth antenna. However, this is not a requirement. The inventors have further recognized that such an armature 120 provides additional interior space that may house one or more components. That is, the armature may be a generally hollow element. Along these lines, the armature 120 may include one or more windows 166, which may be utilized to mount sensors, antennas, etc. These windows may be openings or transparent sections (e.g., radio transparent windows).

In one embodiment, the armature 120 is itself substantially radio transparent. Along these lines, it has been recognized that the multiuse pole typically supports RF antennas or other sensors that provide (or receive) communications from devices that are ground level. Accordingly, by manufacturing the armature from substantially RF transparent materials (e.g., fiberglass) RF interference may be reduced. Though discussed in a system that utilizes the transparent portion, it will be appreciated that the RF transparent armature may be incorporated into any pole system discussed above and equivalents thereof.

Figure 8:
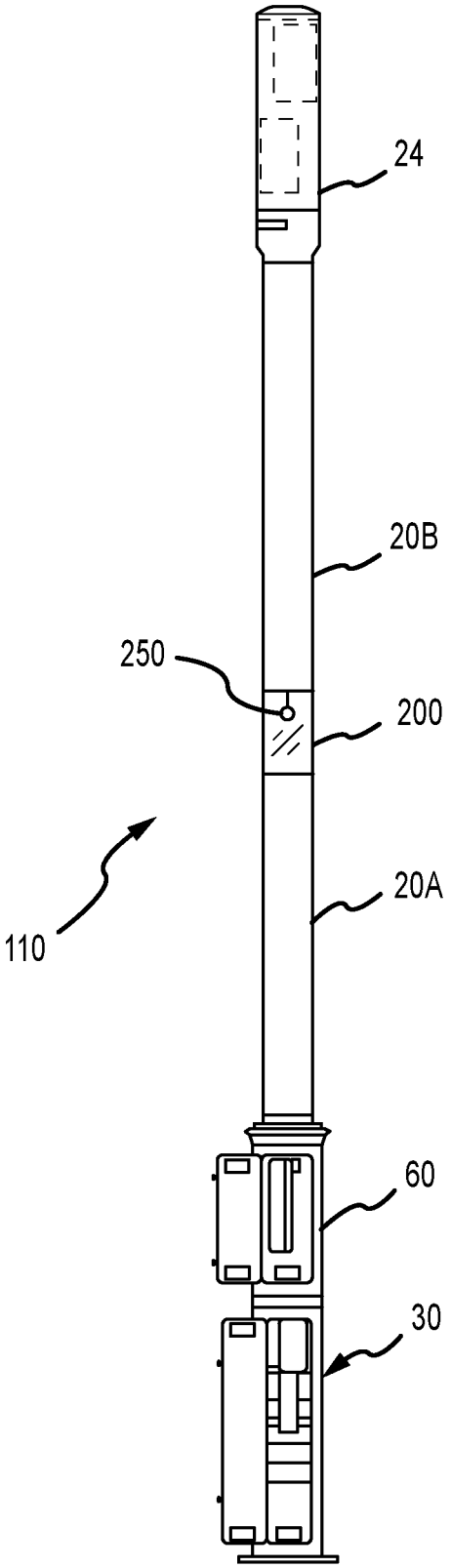
FIG. 8 depicts a second embodiment of a multiuse pole with a transparent section in accordance with the present disclosure.

FIG. 8 illustrate another embodiment of a multiuse pole 110 incorporating a transparent section 200 for use in mounting a camera within an interior of the pole (e.g., within a spatial envelope of the pole). As shown, the multiuse pole 110 includes a lower equipment housing 30 which supports a monopole. In the present embodiment, the monopole includes a lower section 20A and an upper section 20B. In this embodiment, the lower end of the lower monopole 20A is fixedly attached to the equipment housing 30. An upper end of the lower monopole 20A supports a lower end of a transparent or translucent portion or section 200, which houses a camera 250 (e.g., optical, infra-red, ultraviolet etc.) within its hollow interior. An upper end of the transparent section 200 supports a lower end of the upper monopole 20B. The upper end of the upper monopole 20B supports additional components such as an antenna housing 24, which may house one or more antennas. The present embodiment of the multiuse pole 110 may also support an armature (not shown) which may connect to an upper portion of the upper monopole 20B.

In this embodiment, the transparent section 200 experiences greater structural requirements due to the additional structure disposed above and supported by the transparent section 200. Accordingly, it may be desirable to increase the structural rigidity of the transparent section 200. A first option to increase the structural rigidity of the transparent section is to increase the thickness of the sidewall of the transparent section 200. However, sufficient room must remain within the interior of the transparent section to house a camera.

Figure 9A:
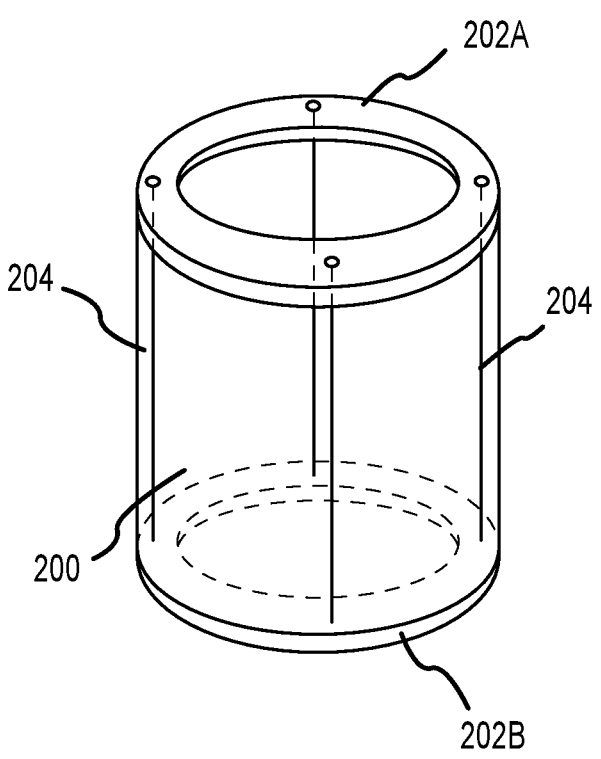
FIGS. 9A and 9B depict reinforcing an annular transparent section.
Figure 9B:
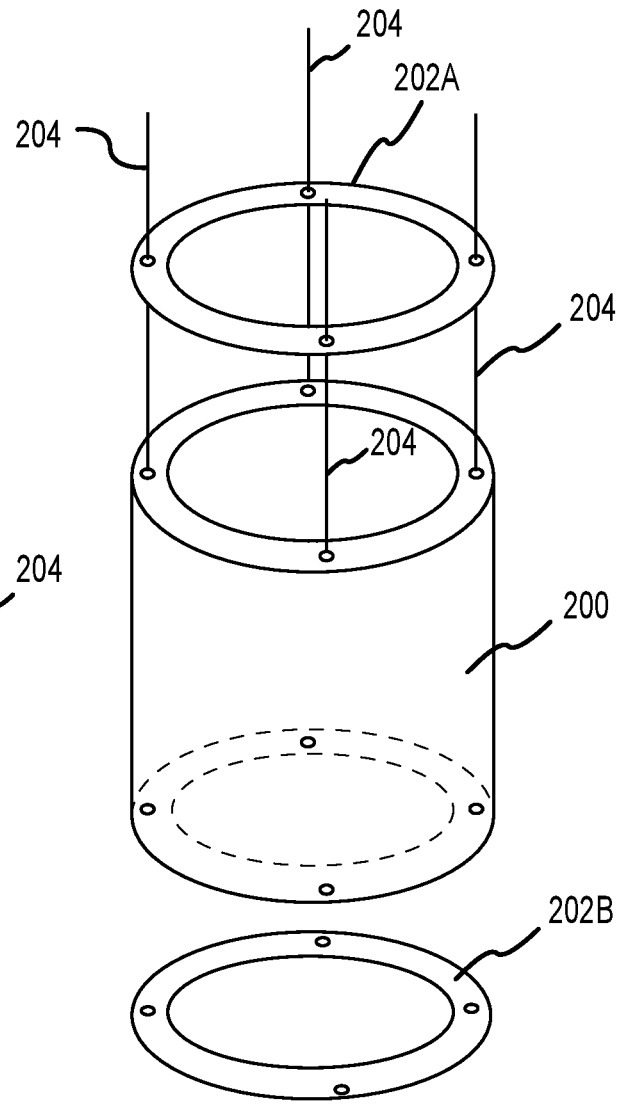

Another option for increasing the structural rigidity of the transparent section is illustrated in FIGS. 9A and 9B. In this embodiment, the transparent section 200 is prestressed or pre-compressed. As shown in these figures, the top and bottom ends of the transparent section 200 are engaged by annular plates 202A and 202B. These plates are disposed against the opposing ends of the transparent section 200 and interconnected by a plurality of wires or rods 204, which extend between and are fixedly connected to the annular plates. In the illustrated embodiment, the rods extend through apertures in the side wall of the transparent section 200. However, it will be appreciated the plates may be oversized compared to the open ends of the transparent section 200 and that the rods 204 may extend on an inside surface of the annular transparent section 200 or alternatively on outside surface of the annular transparent section 200. In any embodiment, the rods 204 may be tensioned to a desired threshold to compress the transparent section 200.

The compression of the transparent section 200 is similar to pre-stressing concrete columns. The compression counteracts tensile loads on a portion of the transparent section that may be caused by a moment applied to the transparent section, for example, by structures supported by the transparent section 200. Such pre-tensioning or compressing significantly increases the overall strength of the transparent section 200.

Figure 10:
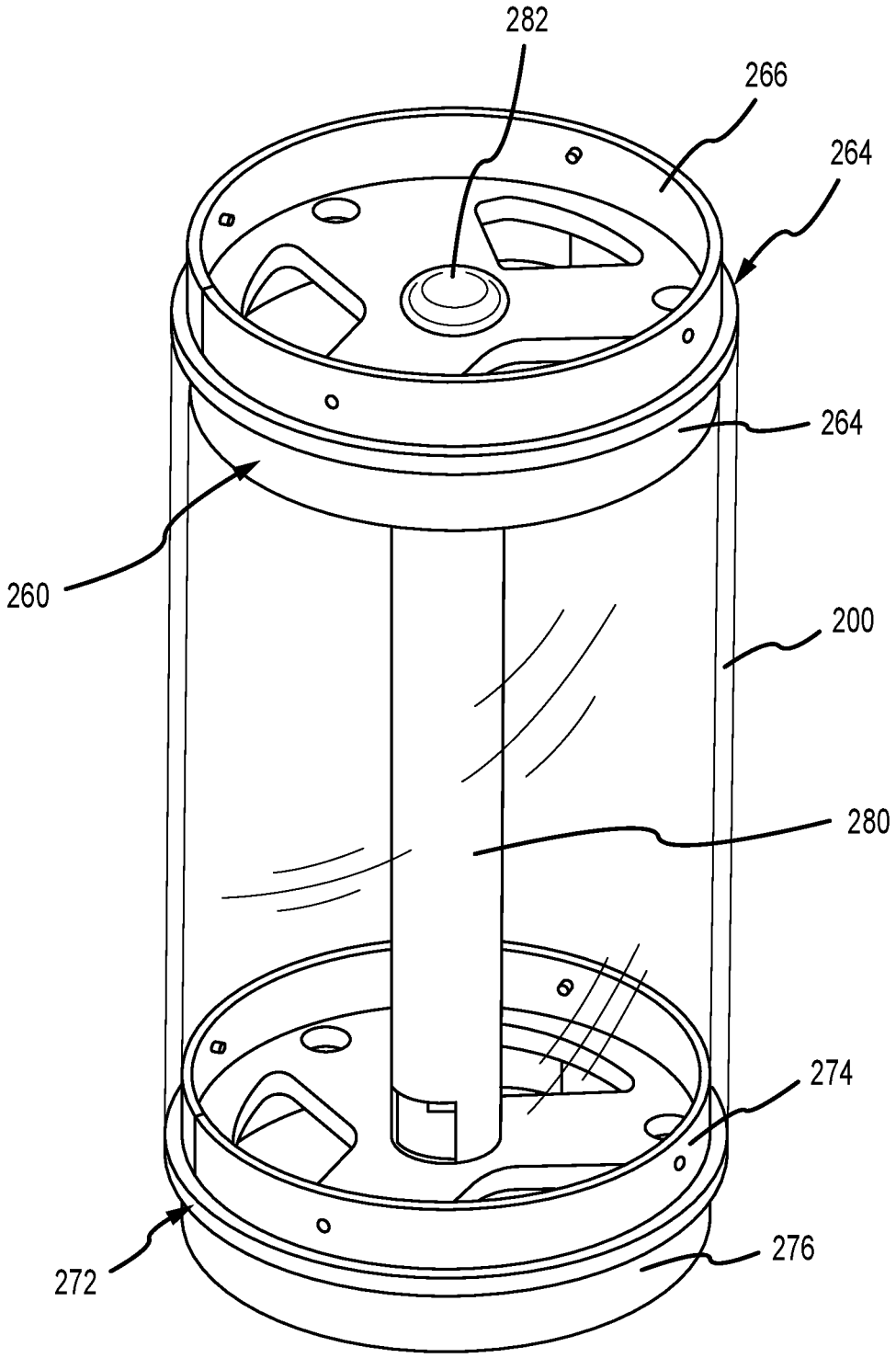
FIG. 10 depicts a support bracket for use with an annular transparent section.

FIG. 10 illustrates another option for increasing the structural rigidity of the transparent section. As shown, a support bracket 260 may incorporated with the transparent section 200. As shown, the support bracket includes an upper bracket 262 having a lower rim or sidewall 264 which may be received within or receive the upper end of the transparent section 200. The present embodiment of the upper bracket further includes an upper sidewall or rim 266 that is configured to engage structure above the transparent section 200. The support bracket further includes a lower bracket 272 having an upper rim or sidewall 274 which may be received within or receive the lower end of the transparent section 200. The present embodiment of the lower bracket 272 further includes a lower sidewall or rim 276 that is configured to engage structure below the transparent section 200. A support shaft 280 extends between and is fixedly connected to the upper bracket 262 and the lower bracket 272.

The support shaft 280 provides additional reinforcement for the transparent section to transfer loads above the transparent section to the pole below the transparent section. Further, the support shaft may be hollow to provide a conduit 282 through the transparent section 200 that will not interfere with the view of a camera(s) disposed within the interior of the transparent section 200. In an arrangement, a camera may be mounted (not shown) to rotate about the exterior of the support shaft. In another arrangement, multiple cameras may be positioned within the interior of the transparent section to provide a 360-degree field-of-view.

Figure 11A:
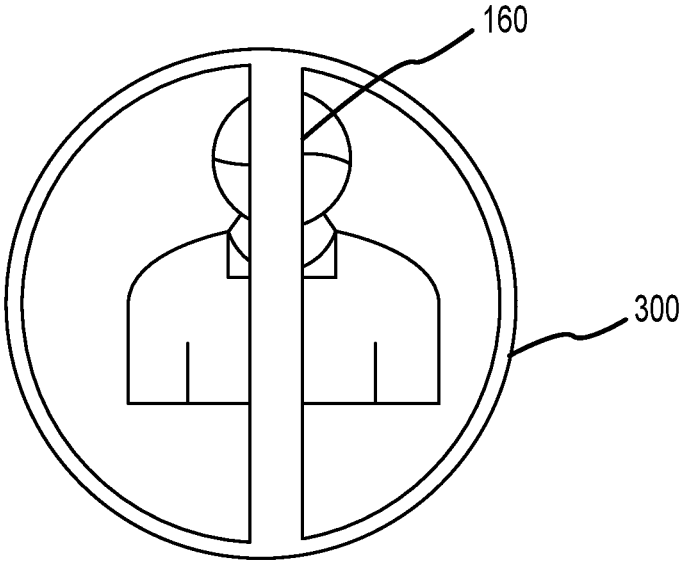
FIGS. 11A and 11B illustrate views from cameras disposed in the annular transparent section.
Figure 11B:
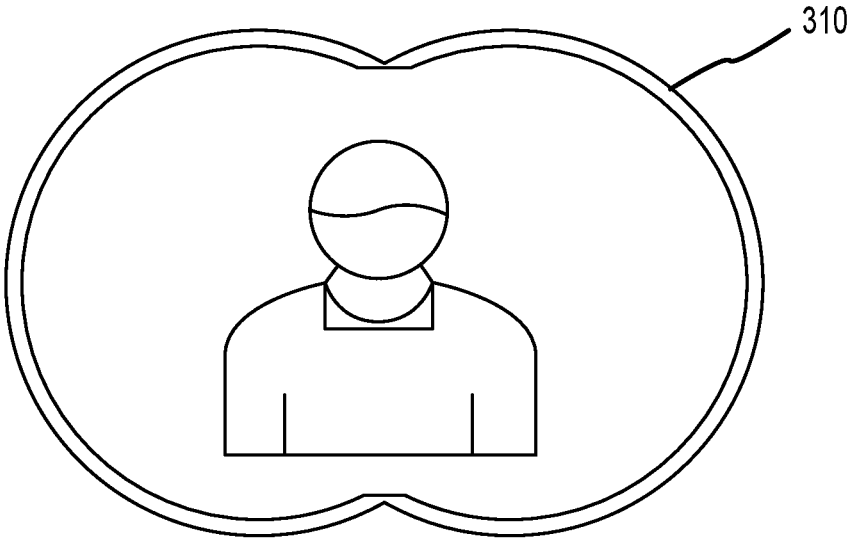

When cabling 160 is routed through the interior of the transparent section 200 (e.g., FIG. 6) or when the transparent section includes tensioning rods 204 (e.g., FIGS. 10A and 10B), the view of a single lens camera may be blocked over a portion of the field-of view. For instance, FIG. 11A illustrates a single lens camera view 300 where a cable 160 blocks a portion of the field of view. In an embodiment, the presented multiuse pole with a transparent section utilizes a dual lens camera to provide a stereo view 310 allowing the dual lens camera to see around near field obstructions due to the different perspectives of the two (or more lenses). Numerous stereo cameras are known in the art including the Bumblebee®2 stereo vision camera available from FLIR SYSTEMS of Wilsonville, Oreg.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A multiuse small cell pole system, comprising:

an equipment housing having a top surface, a bottom surface and a sidewall extending there between defining a generally hollow interior;

a first monopole section having an upper end and a lower end, wherein the lower end is supported by the top surface of the equipment housing;

a transparent pole section that is generally hollow and has lower end connected to the upper end of the first monopole section wherein the transparent pole section is pre-compressed and includes:

an upper plate connected to an upper end of the transparent pole section;

a lower plate connected to the lower end of the transparent pole section; and a plurality of rods extending between the upper plate and lower plate, wherein the plurality of rods may each be tensioned to compress the transparent pole section between the upper plate and the lower plate;

a second monopole section having an upper end and a lower end, wherein the lower end is supported by the upper end of the transparent pole section; and a wireless antenna housing supported by the upper end of the second monopole section.

2. The small cell pole system of claim 1, wherein the first monopole section, the transparent pole section and the second monopole section are each cylindrical elements having substantially identical outside diameters.

3. The small cell pole system of claim 1, further comprising:

a camera disposed within a hollow interior of the transparent pole section.

4. The small cell pole system of claim 3, further comprising:

a coating on an outside surface of the transparent pole section, wherein the coating is a one-way coating that is visibly opaque from outside of the transparent pole section.

5. The small cell pole system of claim 1, wherein the transparent pole section further comprises:

a support bracket having:

an upper bracket connected to the upper end of the transparent pole section; and a lower bracket connected to the lower end of the transparent pole section.

6. The small cell pole system of claim 5, wherein each of the upper bracket and the lower bracket comprises:

an annular rim configured to engage a periphery of the upper or lower end of the transparent pole section; and a plate connected to the annular rim, wherein the plate extends over at least a portion of an interior area defined by the annular rim.

7. The small cell pole system of claim 5, further comprising:

a support shaft extending between the upper bracket and the lower bracket, wherein the support shaft passes through a hollow interior of the transparent pole section.

8. The small cell pole system of claim 1, further comprising:

a light mast connected to the second monopole section and extending transverse to a long axis of the second monopole section.

* * * * *